US009115892B2

(12) United States Patent
Bettinzoli

(10) Patent No.: US 9,115,892 B2
(45) Date of Patent: Aug. 25, 2015

(54) GAS BURNER

(75) Inventor: Angelo Bettinzoli, Concesio (IT)

(73) Assignee: SABAF S.P.A., Ospitaletto (BS) (IT)

( * ) Notice: Subject to any disclaimer, the term of this patent is extended or adjusted under 35 U.S.C. 154(b) by 283 days.

(21) Appl. No.: 13/806,706

(22) PCT Filed: Jun. 30, 2010

(86) PCT No.: PCT/IT2010/000290

§ 371 (c)(1),
(2), (4) Date: Mar. 7, 2013

(87) PCT Pub. No.: WO2012/001714

PCT Pub. Date: Jan. 5, 2012

(65) Prior Publication Data

US 2013/0199513 A1 Aug. 8, 2013

(51) Int. Cl.

| | |
|---|---|
| ***F23D 14/82*** | (2006.01) |
| ***F23D 14/06*** | (2006.01) |
| ***F23D 14/64*** | (2006.01) |

(52) U.S. Cl.

CPC ..... *F23D 14/82* (2013.01); *F23D 14/065* (2013.01); *F23D 14/64* (2013.01); *F23D 2900/14062* (2013.01)

(58) Field of Classification Search

CPC ..... F23D 14/065; F23D 14/82; F23D 14/64; F23D 2900/14062

USPC ..... 431/354; 126/39 E

See application file for complete search history.

(56) References Cited

U.S. PATENT DOCUMENTS

| | | | |
|---|---|---|---|
| 1,818,471 | A | 8/1931 | Geauque |
| 5,567,148 | A | 10/1996 | Krueger et al. |

FOREIGN PATENT DOCUMENTS

| | | | |
|---|---|---|---|
| FR | 355648 | A | 11/1905 |
| FR | 416496 | A | 10/1910 |
| FR | 458367 | A | 10/1913 |
| FR | 1375471 | A | 10/1964 |
| GB | 21078 | | 0/1910 |
| WO | WO2009/077348 | * | 6/2009 |

* cited by examiner

*Primary Examiner* — Alfred Basichas

(74) *Attorney, Agent, or Firm* — Lucas & Mercanti, LLP

(57) ABSTRACT

Gas burner, preferably for domestic use, of the type comprising at least one fuel gas injector and at least one corresponding Venturi effect mixer, wherein the above-mentioned injector faces the intake section of said Venturi effect mixer, and one or more passages for the transit of primary air from above the supporting surface, to which the burner is fixed, to the intake section of the Venturi effect mixer. The burner is also provided with means for preventing flame propagation, of the fluid flow splitting type, which comprises at least one substantially tubular body, with relative lateral walls extending at least between the injector and the intake section of the Venturi effect mixer, advantageously consisting of at least one helically wound filiform element.

12 Claims, 4 Drawing Sheets

Fig.3
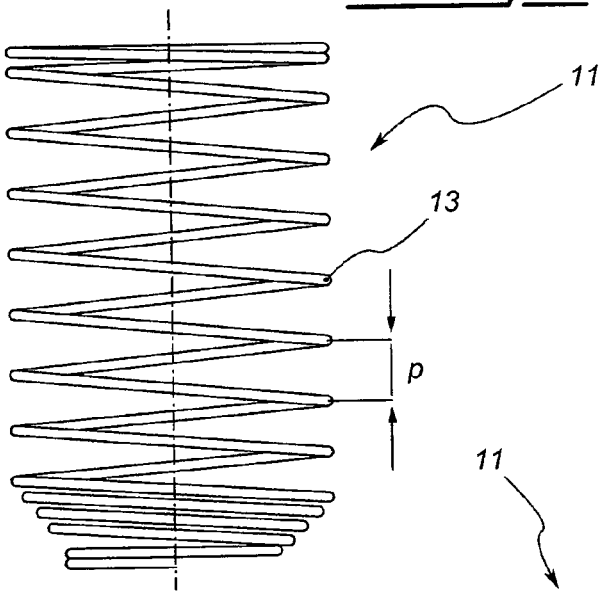
Fig.4
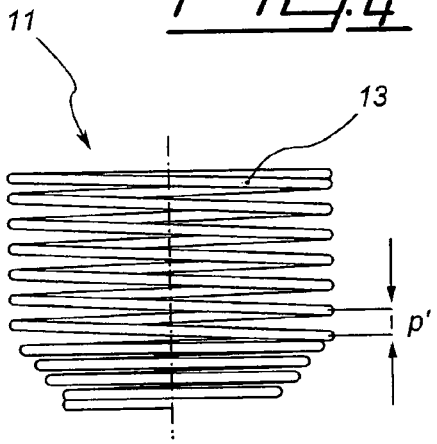
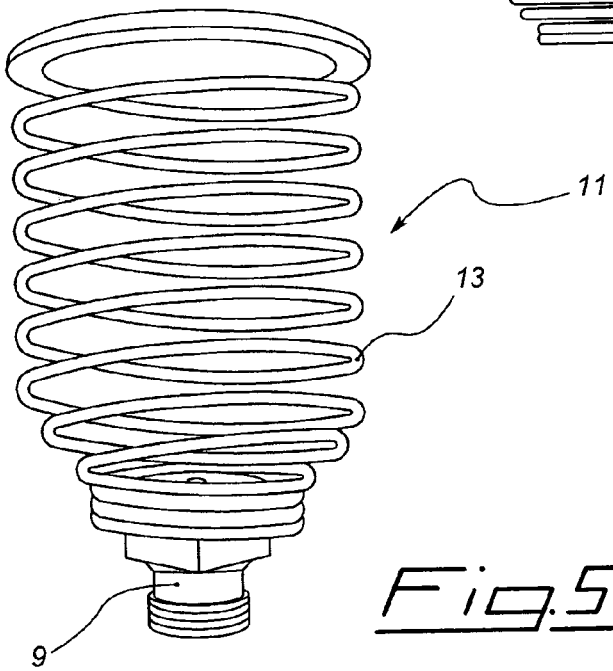
Fig.5

GAS BURNER

CROSS-REFERENCE TO RELATED APPLICATION

This application is a 371 of PCT/IT2010/000290, filed Jun. 30, 2010, the contents of which are incorporated herein by reference.

FIELD OF THE INVENTION

The present invention concerns a gas burner, preferably for domestic use, of the type comprising at least one injector for a fuel gas, and in particular mains gas (or "town gas"), at least one corresponding Venturi effect mixer, the intake section of which is positioned facing the injector, and one or more passages for the transit of primary air from above the hob to which the burner is fixed, through to the above-mentioned intake section of the Venturi effect mixer.

BACKGROUND ART

Gas burners for domestic use provided with primary air suction intakes from above the hob, in particular if provided with axial Venturi effect mixers (i.e. the classic Venturi tubes with convergent-divergent section), can suffer from the drawback of backfire, i.e. the fact that the flame, following the passages of the primary air or fuel mixture, tends to spread also inside the burner, and can reach the Venturi effect mixer and/or the relative fuel gas injector nozzle.

Said effect can frequently occur if the fuel gas used in the burner is mains gas ("town gas", G110-8 mbar), which has a high hydrogen content which can favour rapid flame propagation, for example from the flame spreader towards the inside of the burner.

In particular, if at least one primary air intake is located, as is often the case with modern burners, near the igniter or pilot flames, at ignition the flame can easily spread inside the primary air passages until it laps the injector and the Venturi effect mixer inside the burner, with consequent damage to said components.

In the known art, therefore, perforated cages are used, with substantially tubular development (i.e. provided with lateral walls which, surrounding a longitudinal axis, define a volume inside said cage), which are arranged inside the burner so as to surround the injector and the relative gaseous flow through to the Venturi effect mixer intake section.

More specifically, these cages usually consist of a wire net with fine mesh (for example with mesh of 1 $mm^2$) which, surrounding the injector and the relative gas flow through to the Venturi effect mixer intake section, constitutes a barrier, albeit permeable, to the flow of primary air towards the mixer from the above-mentioned intakes.

The meshes of the above-mentioned cage split the gaseous flow into separate streams, locally increasing the speed of the latter, and thus prevent the flame from spreading beyond the cage and reaching the injector and Venturi effect mixer.

Said cages therefore constitute means for preventing flame propagation inside the burner, acting by splitting the fluid flow into streams, with relative local increase in the transit speed of said fluid.

Although effective in preventing backfire propagation, this solution is onerous and not simple to produce, in addition to involving fairly complex assembly of the various burner components.

In fact, on the one hand the production of a wire net cage having a very fine mesh, and limited construction tolerances, is onerous and technologically complex, and on the other hand assembly of the cage with the burner components, and in particular the need to fit the cage on the injector and to fix it, for example by means of crimping, at the Venturi effect mixer intake section, is a difficult and awkward operation.

One object of the present invention is to produce a gas burner, preferably for domestic use, which is provided with means for preventing propagation of the flame inside the burner without the above drawbacks of the known prior art.

A further object of the present invention is therefore to provide means for preventing flame propagation at the injector and intake section of the corresponding Venturi effect mixer of a gas burner which are simple to produce and easy to assemble inside the burner.

SUMMARY OF THE INVENTION

These and further objects are achieved by the burner according to the first independent claim and the subsequent dependent claims.

The gas burner for domestic use, according to the present invention, comprises at least one fuel gas injector facing the intake section of a corresponding Venturi effect mixer, one or more passages for the transit of primary air from above the supporting surface (preferably a hob), to which the burner is fixed, through to the above-mentioned Venturi effect mixer intake section, and means for preventing flame propagation of the fluid flow splitting type, interposed between the above-mentioned injector and the intake section of the corresponding Venturi effect mixer.

Said means for preventing flame propagation are in turn provided with at least one substantially tubular body, with the relative lateral walls extending at least between the injector and the Venturi effect mixer intake section, which advantageously comprises at least one helically wound filiform element, preferably consisting of a helical metal spring.

The use of a helically wound filiform element, naturally with calibrated coil pitch preferably between 0.3 and 1.2 mm, to produce the tubular body for preventing the passage of the flame, is advantageous both in terms of realisation, due to the relative simplicity of production of such component, and in terms of assembly, given the considerable dimensional adaptability thereof.

Furthermore, in the case of use of a helical spring, or if the helically wound filiform element is a wire made for example of spring steel or stainless spring steel, the elastic characteristic of said spring permits easy assembly and adaptation thereof in the gas burner, as an effective means for preventing flame propagation.

The use of a helical spring as a means for preventing flame propagation, interposed between injector and intake section of the relative Venturi effect mixer, is also particularly advantageous if the injector has to be replaced, for example to adapt the burner to a different type of fuel gas, or if the injector and adjacent chamber have to be cleaned, given that disassembly and subsequent assembly of said helical spring is extremely simple and can be easily performed by the end user.

It should be noted that, as the Applicant has verified in practice, the use of means for preventing flame propagation consisting of a tubular body made of a helically wound filiform element, in particular in a burner provided with a mixer consisting of an axial Venturi tube and with the use of mains (town) gas (e.g. G110 at 8 mbar), has proved to be extremely effective in preventing flame propagation inside the burner at the level of the mains (town) gas injector and relative Venturi tube.

BRIEF DESCRIPTION OF THE FIGURES

A preferred embodiment of the present invention will now be described, solely by way of non-limiting example, with reference to the attached figures, in which:

FIG. 3 is a lateral view of a helical spring, in a non-loaded configuration, which can be used in the burner of the preceding figures;

FIG. 4 is a lateral view of the helical spring of FIG. 3, in a compressed configuration, during operation;

FIG. 5 is a schematic view in perspective of the spring of FIGS. 3 and 4 fitted on the injector of the burner of FIGS. 1 and 2;

DETAILED DESCRIPTION OF SOME PREFERRED EMBODIMENTS OF THE PRESENT INVENTION

Figure 1:
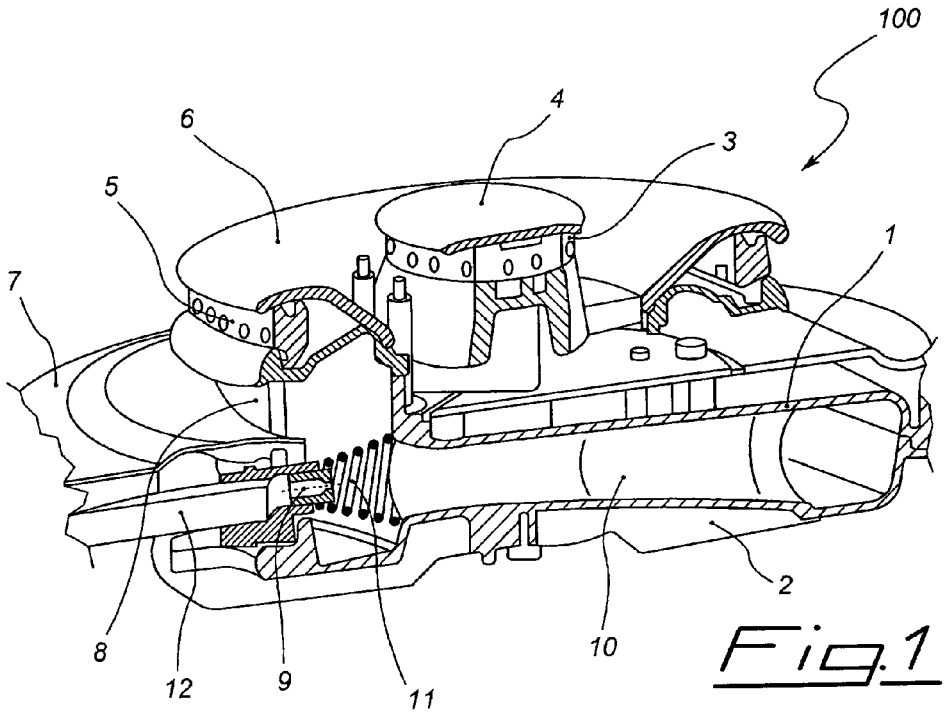
FIG. 1 is a schematic section view of a gas burner for domestic use according to a preferred embodiment of the present invention.

With reference first to FIG. 1, the gas burner 100 for domestic use illustrated herein, in particular suitable for cooking, according to the known technique, comprises a cup 2 on which the body 1 of the burner is mounted, which in turn is provided with one or more flame spreaders 3, 5 with relative covers 4, 6. The cup 2, designed to be fixed to a supporting surface 7, constituting the hob, is provided with at least one injector 9 which, connected to a relative inflow duct 12 of a fuel gas, faces the intake section of a corresponding Venturi effect mixer 10, with which the burner 100 is also provided.

Figure 2:
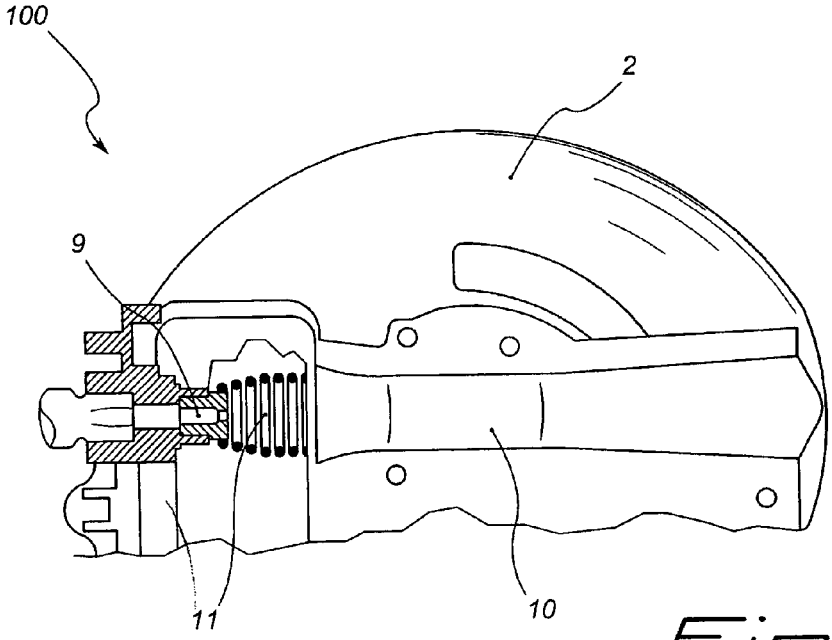
FIG. 2 is a partial schematic overhead plan view of the cup of the burner of FIG. 1.

In particular, as can be seen also in FIG. 2, the Venturi effect mixer, which according to a particular embodiment of the present invention can be an axial Venturi tube 10 (convergent-divergent), arranged for example along a horizontal axis or an axis slightly inclined downwards, can be obtained partly in the cup 2 and partly in the body 1 of the burner, so that said Venturi tube 10 is fully defined only when the cup 2 and the body 1 of the burner are reciprocally assembled.

The burner 100 of the present invention also comprises passages 8 to permit the inflow of primary air, drawn by the Venturi tube 10, from above the hob 7 towards the chamber inside the burner 100 into which the injector 9 and the intake section of said Venturi tube 10 raise.

More specifically, the Venturi tube 10 which, as is known, when traversed by the flow of gas coming out of the injector 9, generates a vacuum upstream of its restricted section, draws primary air coming from above the hob 7, due to said passages 8 which provide the fluid connection between said Venturi tube 10 and the external environment.

It should be noted that, given the possible proximity of the suction intakes of the passages 8 to the igniter of the burner 100 and/or to the pilot flames coming from the flame spreaders 3, 5, it cannot be ruled out that a flame, given also the low speed of the primary air going into said intakes of the passages 8, may reach—in particular during the transient of the turning-on, the injector 9 and the Venturi tube 10, potentially damaging said components.

To prevent this occurrence, the burner 100 illustrated herein, according to the present invention, comprises means for preventing flame propagation, of the fluid flow splitting type, interposed between the injector 9 and the intake section of the Venturi tube 10.

Said preventing means, as can be seen in the embodiment shown here in the figures, comprise a substantially tubular body 11, advantageously consisting of a helically wound filiform element, whose lateral walls, which develop around a longitudinal axis, extend between the injector 9 and the intake section of the Venturi tube 10.

Note that here and below, the expression "substantially tubular body" indicates a body provided with lateral walls which surround a longitudinal axis of said body, so as to define an internal volume for the entire longitudinal length of the body. In this specific case, the substantially tubular body 11 described here can preferably be a body provided with interconnected cylindrical sections.

By appropriately calibrating the distance (pitch) between the coils of said substantially tubular body 11, the fluid flow sucked in by the Venturi tube 10 can be broken up—or split into different fluid streams—and its speed locally increased (since it has to pass through the restricted spaces of the body 11), so as to prevent any flame entering the burner 100 from spreading, reaching said Venturi tube 10 and relative injector 9.

More specifically, according to a preferred embodiment of the present invention, the pitch between the coils of the substantially tubular body 11 can be between 0.3 and 1.2 mm, and preferably can be equal to 0.7-0.8 mm.

With reference also to FIGS. 3-5, the above-mentioned helically wound filiform element can preferably be a wire 13, for example with circular or polygonal section, and even more preferably can be a wire, for example made of spring steel or stainless spring steel, constituting a helical spring.

In the case of use of a helical spring 11, even with non-constant diameter, the pitch (p') of the coils of said spring 11, in its operating conformation, i.e. when the spring 11 is mounted and operating inside the burner, can be advantageously chosen between 0.3 and 1.2 mm, so as to constitute an effective barrier to propagation of the flame towards the injector 9.

Note that the use of a helical spring 11 as a means for preventing flame propagation interposed between injector 9 and intake section of the Venturi tube 10, or other Venturi effect mixer, makes the assembly of said preventing means extremely simple.

In fact, as will be evident to a person skilled in the art, it is sufficient to provide appropriate retainers (or stops) around the intake section of the Venturi tube 11 and around the injector 9 in order to easily fit—and if necessary disassemble and re-fit—the spring 11, appropriately compressed, between Venturi tube 11 and injector 9.

This considerable ease of assembly of the helical spring 11 facilitates any replacement of the injector 9, necessary for example if the fuel gas injected into the burner 100 is changed, or for cleaning said injector 9, also by the end user who only has to further compress the spring 11, remove it, change the injector 9 and then, compressing it, re-position it inside the relative retainers provided on the Venturi tube 10 and on the injector 9.

According to a particular embodiment of the present invention, the body 11, substantially tubular, can also have a generally circular section with constant or variable diameter along its longitudinal development.

As can be seen in particular in FIGS. 3 to 5, the tubular body 11, in the form of a helical spring, has a substantially circular transverse section, which has initially, at the end of said body 11 designed to be fitted on the injector 9, a reduced diameter, and subsequently has a diameter which, becoming progressively larger, is able to surround, at the end designed to couple with the Venturi tube 10, the entire intake section of the latter.

Note that, although a burner provided with one single injector and relative Venturi effect mixer is described above, the solution claimed here can easily be adapted to gas burners, preferably for domestic use, provided with two or more Venturi effect mixers with corresponding injectors.

Figure 6:
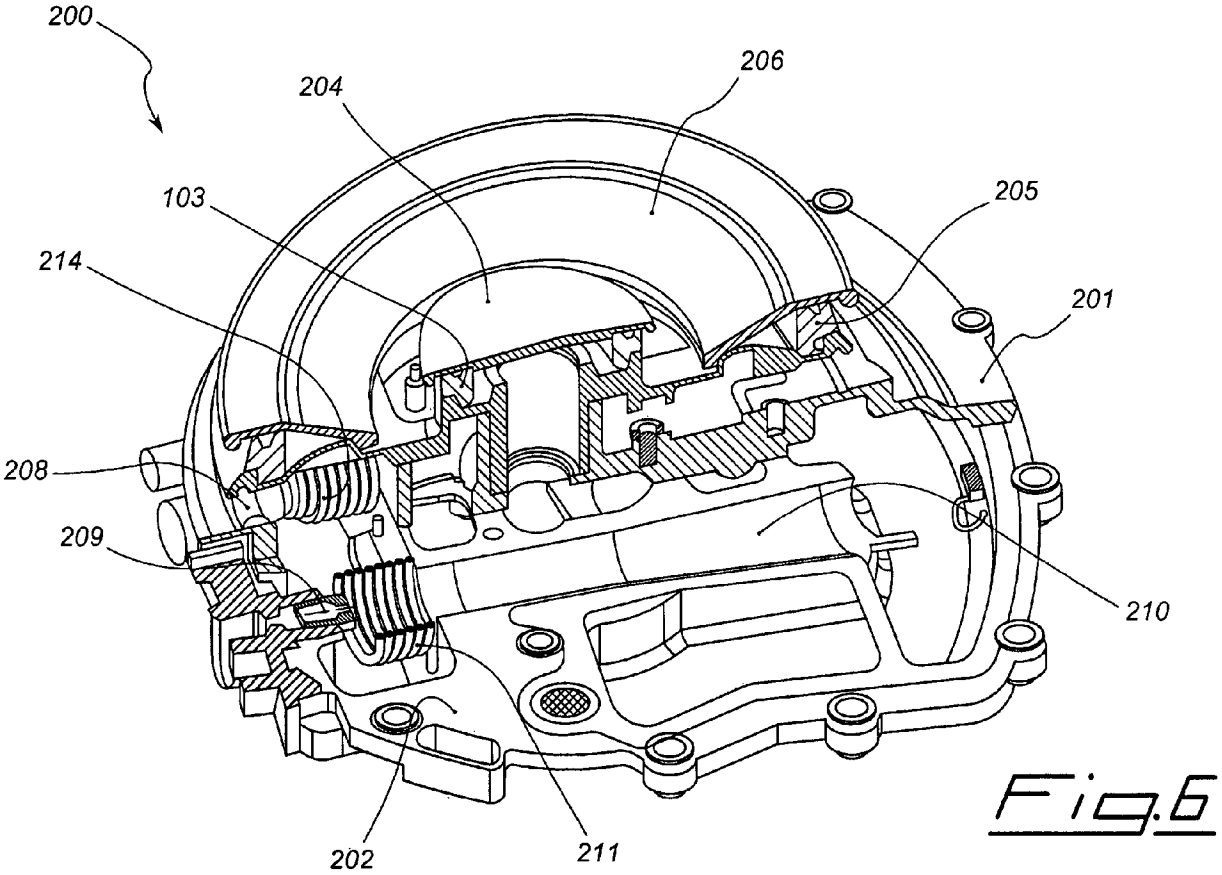
FIG. 6 is a schematic section view of a gas burner for domestic use provided with two Venturi effect mixers, according to another embodiment of the present invention.

In fact, FIG. 6 illustrates a gas burner 200 for cookers, according to a particular embodiment of the present invention, of the type comprising a cup 202 on which a relative body 201 of the burner is mounted, which is shaped so as to define two chambers for distribution of the fuel mixture—one central chamber and one toroidal external chamber—respectively provided with ring-shaped flame spreaders 203, 205 and relative removable covers 204, 206.

The cup 202 and the body 201 of the burner 200 define, once coupled, two Venturi effect mixers 210, which in the case in point consist of two axial Venturi tubes, and a plurality of passages 208 for the inflow of primary air from above the supporting surface of the burner 200 to the intake sections of the two Venturi tubes 210.

The primary air intakes of said passages 208, as can be easily seen, are in particular arranged near the external flame spreader 205, below the latter, so that any backfire, generated during the transient of the turning-on of the burner 200, and passing inside said burner 200 in said passages 208, cannot be excluded.

Analogously to the burner 100 described above, furthermore, the Venturi tubes 210, as can be seen in FIG. 6, are associated with two respective injectors, 209 for injection inside them of a flow of fuel gas (for example mains (town) gas).

Between each injector 209 and the intake section of the relative Venturi tube 210, according to a preferred embodiment of the present invention, a respective helical spring 211, 214 is interposed, with variable diameter circular section and coil pitch preferably between 0.3 and 1.2 mm, and relative lateral walls extending between the injector 209 and the above-mentioned intake section of the relative Venturi tube 210, thus defining an internal volume for passage of the fuel gas flow.

The particular coil pitch of the springs 211, 214, which can be between 0.3 and 1.2 mm and preferably equal to 0.7-0.8 mm, analogously to the spring 11, allows said springs 211, 214 to prevent propagation of any backfire towards the Venturi tubes 210 and the relative injectors 209.

The use of springs 211, 214, as already described in relation to use of the spring 11, facilitates assembly and disassembly of said springs 211, 214, thus favouring and simplifying any operations for replacement of the injectors 209 or internal cleaning of the burner 200.

As will be evident to a person skilled in the art, the means for preventing flame propagation described above can be easily used also in burners provided with a radial type Venturi effect mixer.

Figure 7:
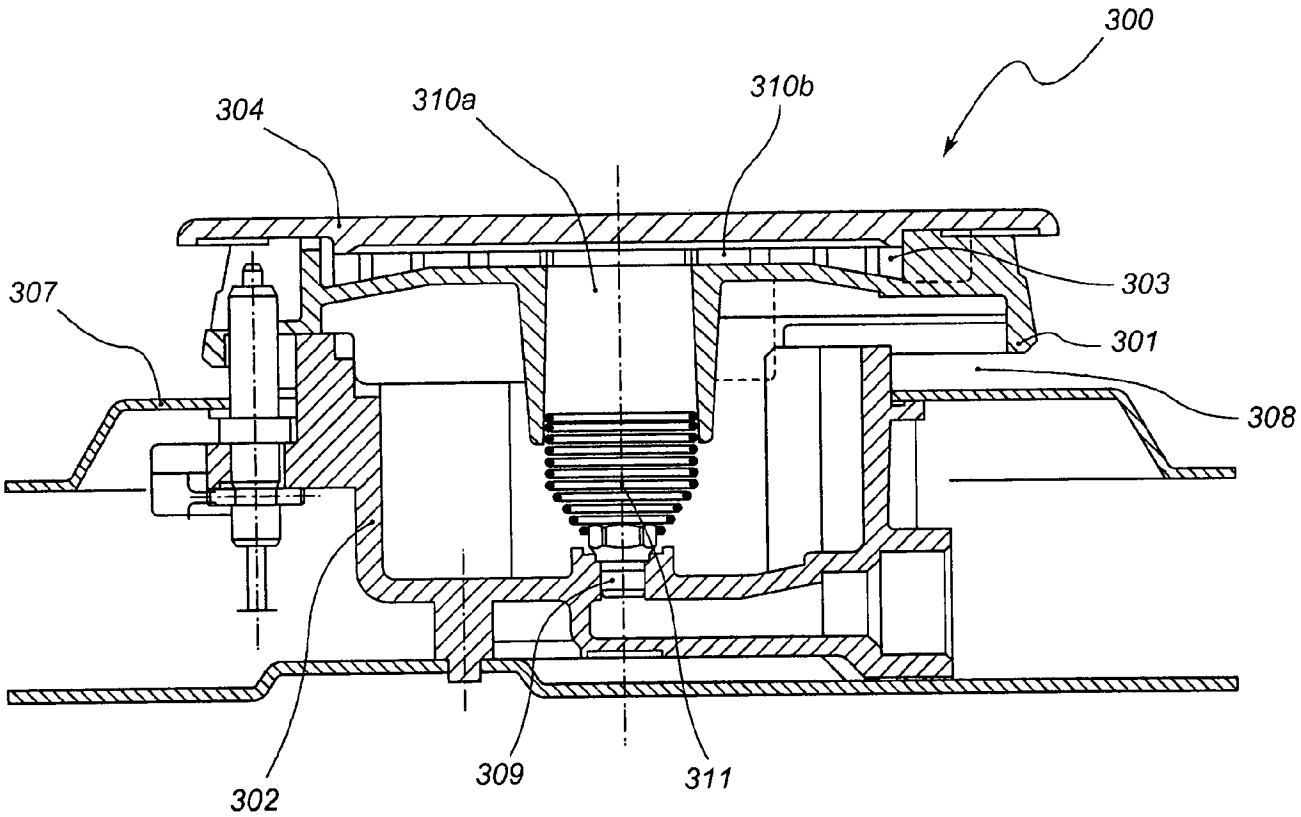
FIG. 7 is a section view of a gas burner for domestic use comprising a radial Venturi effect mixer, according to a further embodiment of the present invention.

With reference to FIG. 7, such a burner 300, according to a particular embodiment of the present invention, can comprise a cup 302, secured to a supporting surface 307, a body of the burner 301, mounted on the above-mentioned cup 302, at least one flame spreader 303 and a relative cover 304, in addition to a Venturi effect mixer of the radial type, the fluid intake section 310*a* of which, convergent, and the radial expansion section 310*b*, positioned immediately downstream of the relative restricted section, are indicated in the figure.

The burner 302 also comprises a passage 308 for the inflow of primary air, drawn by the Venturi effect mixer 310*a*, 310*b*, from above the supporting surface 307, and a fuel gas injector 309 positioned upstream of the intake section 310*a*.

Advantageously, the burner 300 also comprises means for preventing flame propagation, extending between the injector 309 and the radial type Venturi effect mixer inflow section 310*a*, 310*b*, consisting, according to a particular embodiment of the present invention, of a helical spring 311, for example made of stainless spring steel, with coil pitch equal to 0.7-0.8 mm, measured when the spring 311 is in operation.

Analogously to what is described above with reference to the burners 100 and 200, the spring 311 is extremely effective in preventing the entry of any backfire which, during the transient of the turning-on, could penetrate inside the passage 308 and reach the injector 309 and the Venturi effect mixer 310*a*, 310*b*, and at the same time is simple to assemble and disassemble, if it is necessary to carry out operations for replacement of the injector 309 or maintenance and/or cleaning of said injector 309 or Venturi effect mixer 310*a*, 310*b*.

Lastly, as already anticipated, it should be remembered that the gas burner 100, 200 or 300 for domestic use, claimed here, can be effectively used with mains (town) gas (G110), given that the high hydrogen content of said gas makes the propagation of backfire inside said burner 100 or 200 or 300 through the primary air passages 8 or 208 extremely easy.

The invention claimed is:

1. Gas burner comprising at least one fuel gas injector and at least one corresponding Venturi effect mixer, said at least one injector facing the intake section of the corresponding Venturi effect mixer, as well as one or more passages for the transit of primary air from above the supporting surface, to which the burner is fixed, to said intake section of said Venuri mixer, and means for preventing flame propagation, of the fluid flow splitting type, said means for preventing flame propagation comprising at least one substantially tubular body with the relative lateral walls extending at least between said at least one injector and said intake section of said Venturi effect mixer, wherein said at least one substantially tubular body comprises at least one helically wound filiform element, the helically wound filiform element being interposed between the injector and an intake section of the Venturi mixer.

2. Gas burner as claimed in claim 1, wherein said at least one filiform element is a wire.

3. Gas burner as claimed in claim 1, wherein said substantially tubular body has a generally circular section.

4. Gas burner as claimed in claim 3, wherein said substantially tubular body has a circular section with variable diameter along its longitudinal development.

5. Gas burner as claimed in claim 1, wherein the coil pitch of said at least one helically wound filiform element is between 0.3 and 1.2 mm.

6. Gas burner as claimed in claim 1, wherein said at least one substantially tubular body is a helical spring.

7. Gas burner as claimed in claim 6, wherein the coil pitch (p') of said helical spring, when operating, is between 0.3 and 1.2 mm.

8. Gas burner as claimed in claim 1, wherein said at least one Venturi effect mixer is an axial Venturi tube.

9. Gas burner as claimed in claim 1, wherein said at least one Venturi effect mixer is a radial type Venturi effect mixer.

10. Gas burner as claimed in claim 1, wherein said fuel gas is a gas with a high hydrogen content.

11. Gas burner as claimed in claim 1, wherein the gas burner is designed for domestic use.

12. Gas burner as claimed in claim 1, wherein the one or more passages for the transit of primary air are configured to direct the primary air laterally through the helically wound filiform element.

* * * * *